US008248262B2

(12) United States Patent
Robison, Jr. et al.

(10) Patent No.: US 8,248,262 B2
(45) Date of Patent: Aug. 21, 2012

(54) EVENT RECOGNITION AND RESPONSE SYSTEM

(75) Inventors: Charles Delbert Robison, Jr., Round Rock, TX (US); Douglas Evan Messick, Austin, TX (US); Kyle Eric Cross, Pflugerville, TX (US)

(73) Assignee: Dell Products L.P., Round Rock, TX (US)

( * ) Notice: Subject to any disclaimer, the term of this patent is extended or adjusted under 35 U.S.C. 154(b) by 413 days.

(21) Appl. No.: 12/539,176

(22) Filed: Aug. 11, 2009

(65) Prior Publication Data

US 2011/0037605 A1 Feb. 17, 2011

(51) Int. Cl.
*G08B 21/00* (2006.01)

(52) U.S. Cl. ..... 340/686.1; 340/540; 340/539.22; 340/539.26

(58) Field of Classification Search ..... 340/686.1
See application file for complete search history.

(56) References Cited

U.S. PATENT DOCUMENTS

| | | | | |
|---|---|---|---|---|
| 5,781,852 | A | 7/1998 | Gropper | |
| 6,452,492 | B1 | 9/2002 | Drury | |
| 6,539,400 | B1 * | 3/2003 | Bloomfield et al. | 1/1 |
| 6,634,768 | B2 | 10/2003 | McKenzie | |
| 7,884,714 | B2 * | 2/2011 | Fein et al. | 340/539.22 |
| 2001/0004234 | A1 * | 6/2001 | Petelenz et al. | 340/539 |
| 2002/0028704 | A1 * | 3/2002 | Bloomfield et al. | 463/1 |
| 2008/0136623 | A1 * | 6/2008 | Calvarese | 340/539.11 |

* cited by examiner

*Primary Examiner* — George Bugg
*Assistant Examiner* — Kerri McNally
(74) *Attorney, Agent, or Firm* — Haynes and Boone, LLP

(57) ABSTRACT

An event recognition and response system includes an event sensor. An event recognition engine is coupled to the event sensor. An action profile database is coupled to the event recognition engine. The event recognition engine is operable to receive an event input from the event sensor, compare the event input to a plurality of action profiles in the action profile database and, upon determining that at least one action profile in the action profile database matches the event input, perform a predetermined action.

17 Claims, 3 Drawing Sheets

EVENT RECOGNITION AND RESPONSE SYSTEM

BACKGROUND

The present disclosure relates generally to information handling systems, and more particularly to an event recognition and response system in an information handling system.

As the value and use of information continues to increase, individuals and businesses seek additional ways to process and store information. One option is an information handling system (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

Some IHS users may find themselves distracted and/or unable to recognize events in the vicinity of their IHS for a variety of reasons such as, for example, the user being hearing-impaired, the user listening to music, the user not being near their IHS, and/or a variety of other reasons. These users may find themselves unable to respond to these events such as, for example, a baby crying, a phone ringing, an alarm sounding, and/or a variety of other events. Furthermore, even if users are able to recognize these events, they may find themselves unable to respond quickly enough, or it may simply be inconvenient to provide a response.

Accordingly, it would be desirable to provide an event recognition and response system to replace or supplement an IHS users ability to recognize and respond to events.

SUMMARY

According to one embodiment, an event recognition and response system includes an event sensor, an event recognition engine coupled to the event sensor, and an action profile database coupled to the event recognition engine, wherein the event recognition engine is operable to receive an event input from the event sensor, compare the event input to a plurality of action profiles in the action profile database and, upon determining that at least one action profile in the action profile database matches the event input, perform a predetermined action.

DETAILED DESCRIPTION

For purposes of this disclosure, an IHS may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an IHS may be a personal computer, a PDA, a consumer electronic device, a network server or storage device, a switch router or other network communication device, or any other suitable device and may vary in size, shape, performance, functionality, and price. The IHS may include memory, one or more processing resources such as a central processing unit (CPU) or hardware or software control logic. Additional components of the IHS may include one or more storage devices, one or more communications ports for communicating with external devices as well as various input and output (I/O) devices, such as a keyboard, a mouse, and a video display. The IHS may also include one or more buses operable to transmit communications between the various hardware components.

Figure 1:
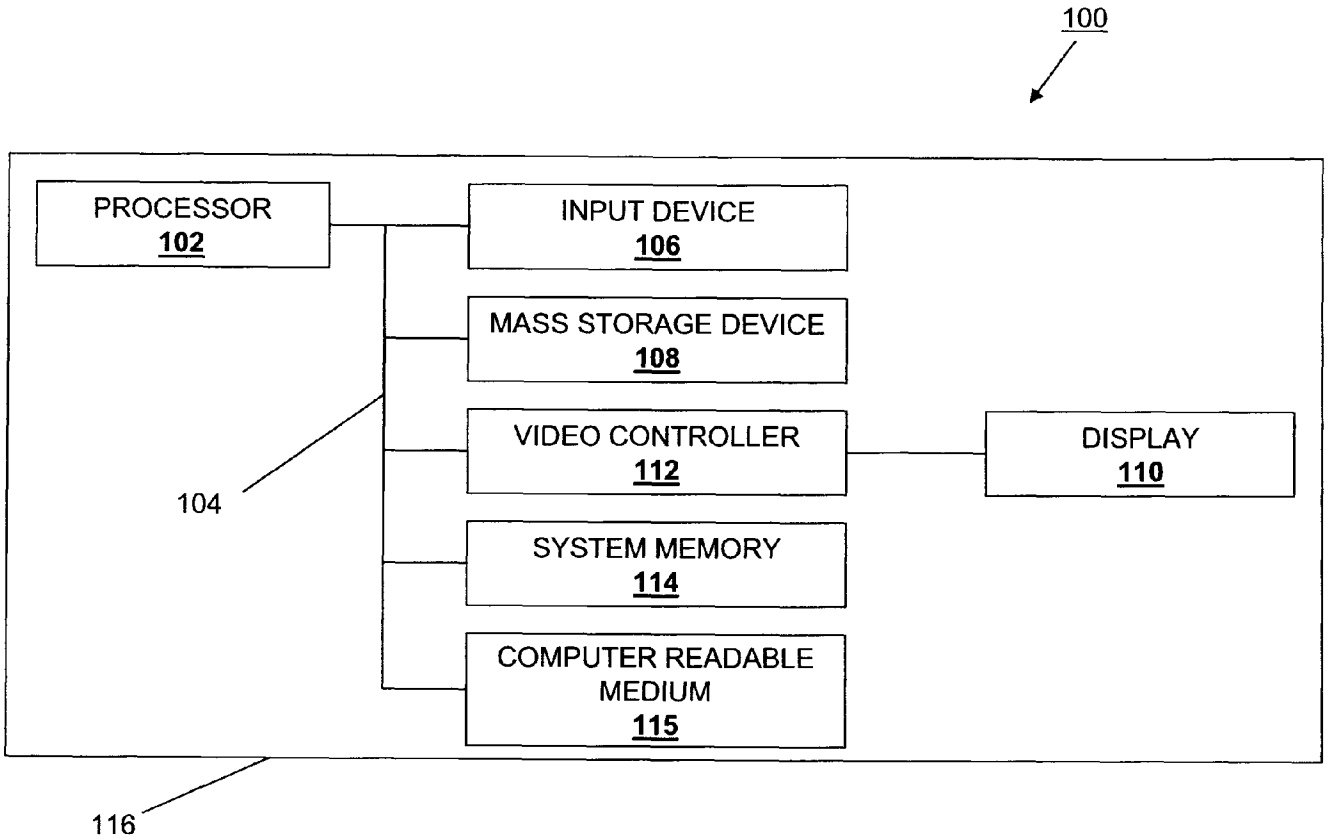
FIG. 1 is a schematic view illustrating an embodiment of an IHS.

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs, and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. Examples of system memory may include random access memory (RAM) devices such as dynamic RAM (DRAM), synchronous DRAM (SDRAM), solid state memory devices, and/or a variety of other memory devices known in the art. A computer-readable medium 115 is coupled to the processor 102 and may include the mass storage device 108, the system memory 114, and/or a variety of other computer-readable mediums known in the art. The computer-readable medium 115 stores (e.g., encodes, records, or embodies) computer-executable instructions/functional descriptive material (e.g., including but not limited to software (e.g., computer programs or applications) or data structures). Such functional descriptive material imparts functionality when encoded on the computer-readable medium 115. For example, the processor 102 may read (e.g., access or copy) such functional descriptive material from the computer-readable medium 115 onto the system memory 114, and the processor 102 may then perform operations in response to such material. In an embodiment, a chassis 116 houses some or all of the components of IHS 100. It should be understood that other buses and intermediate circuits can be deployed between the components described above and processor 102 to facilitate interconnection between the components and the processor 102.

Figure 2:
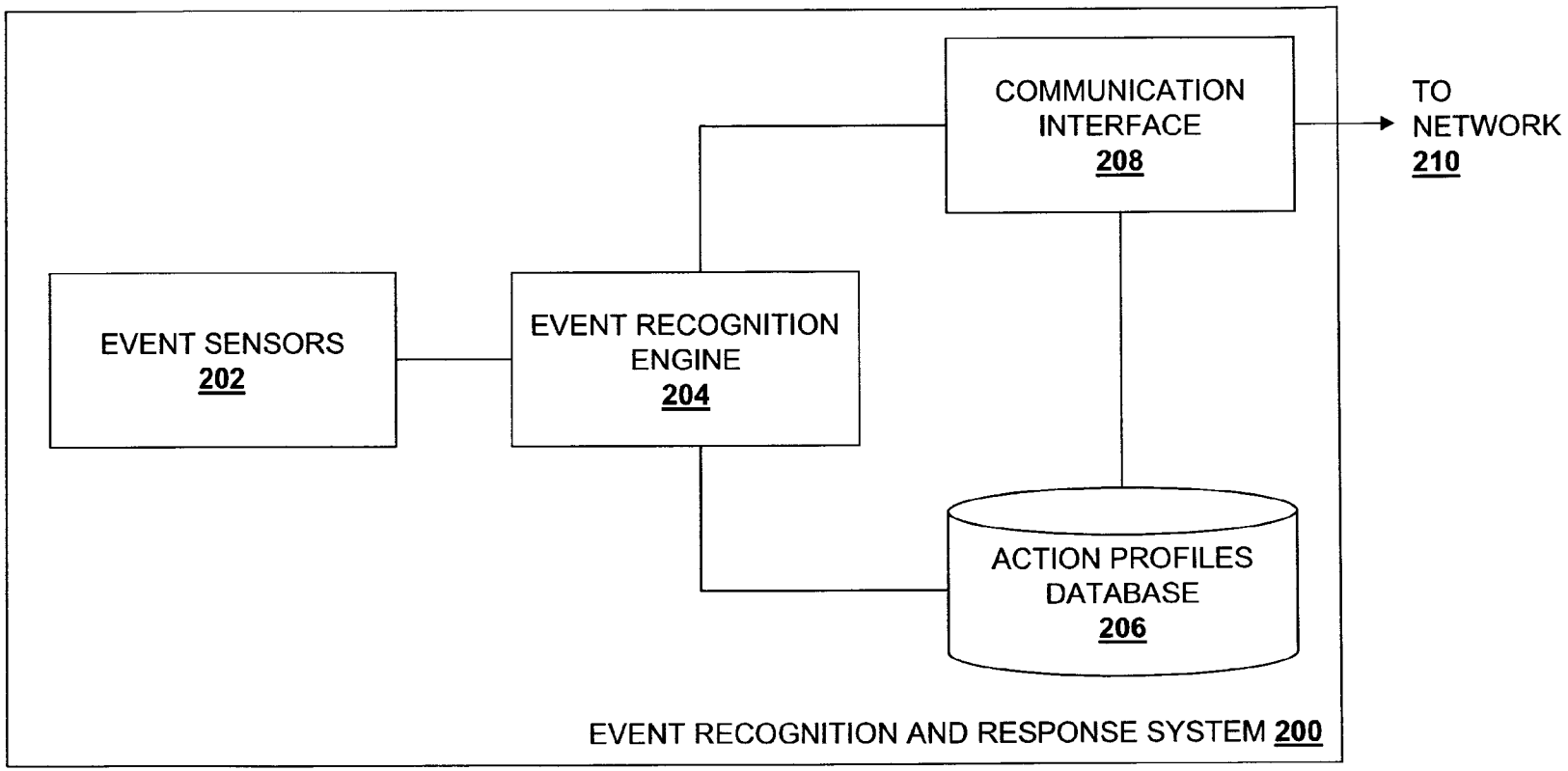
FIG. 2 is a schematic view illustrating an embodiment of an event recognition and response system.

Referring now to FIG. 2, an event recognition and response system 200 is illustrated. In an embodiment, the event recognition and response system 200 may be included in the IHS 100, described above with reference to FIG. 1. The event recognition and response system 200 includes one or more event sensors 202. The one or more event sensors 202 may be a sound event sensor (e.g., a microphone or other sensor known in the art for detecting sound), a location event sensor (e.g., a global positioning system (GPS) or other sensor known in the art for detecting location), a light event sensor (e.g., a photoelectric sensor or other sensor known in the art for detecting light), a chemical event sensor, a movement event sensor (e.g., an accelerometer or other sensor known in the art for detecting movement), a directional event sensor (e.g., a magnetometer or other sensor known in the art for detecting direction), combinations thereof, and/or a variety of other sensors known in the art. In an embodiment, the one or more event sensor 202 are coupled to or mounted in the chassis 116 of the IHS 100, described above with reference to FIG. 1. An event recognition engine 204 is coupled to the one or more event sensors 202. In an embodiment, the event recognition engine 204 includes software that is located on a computer-readable medium such as, for example, the computer-readable medium 115 of the IHS 100, described above with reference to FIG. 1. An action profiles database 206 is coupled to the event recognition engine 204. In an embodiment, the action profiles database 206 includes a plurality of action profiles, and each action profile includes at least one event and at least one predetermined action to be performed in response to detecting at least one event, as will be described in further detail below with reference to the method 300. In an embodiment, the action profiles database 206 includes a database that is located on a computer-readable medium such as, for example, the computer-readable medium 115 of the IHS 100, described above with reference to FIG. 1. A communication interface 208 is coupled to the event recognition engine 204, the action profiles database 206, and to a network 210 and is operable to transfer data (e.g., software updates) through the network 210 to the event recognition engine 204, transfer action profiles through the network 210 to the action profile database 206, and/or provide a variety of other communication functions known in the art. In an embodiment, the action profiles database 206 may be located outside of the IHS 100, and the event recognition engine 204 may access the action profiles database 206 through the network 210 using the communication interface 208.

Figure 3:
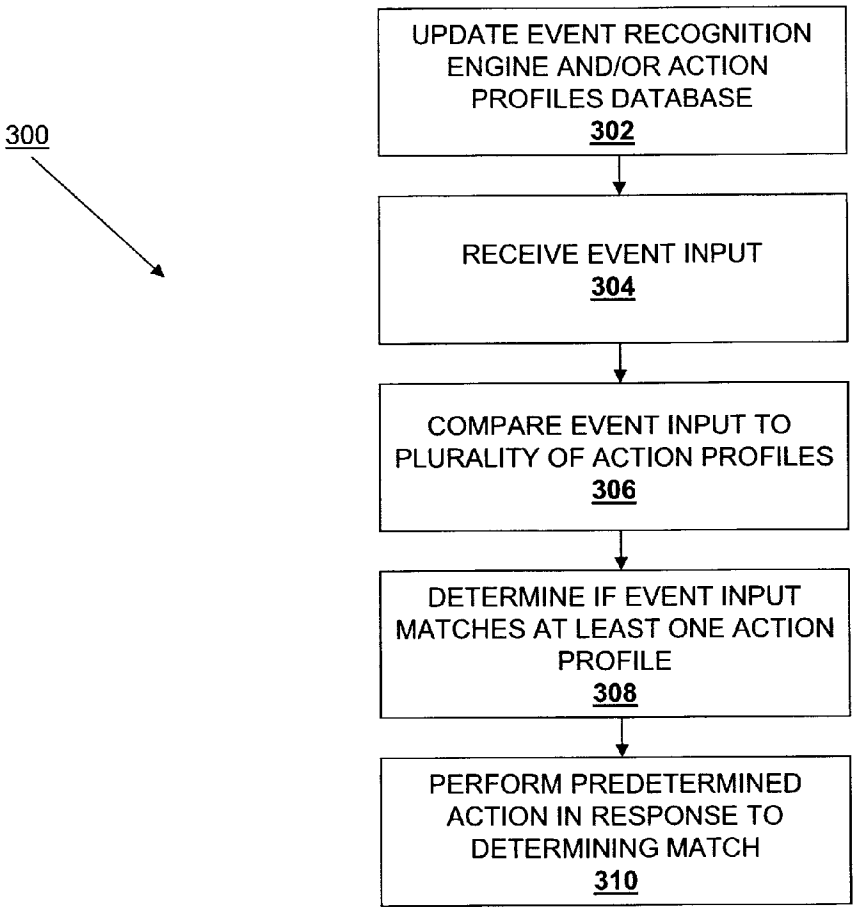
FIG. 3 is a flow chart illustrating an embodiment of a method for recognizing an event and providing a response.

Referring now to FIG. 3, a method 300 for recognizing an event and providing an response is illustrated. The method 300 begins at block 302 where the event recognition engine 204 and/or the action profiles database 206 may be updated. In an embodiment, the event recognition engine 204 may use the communication interface 208 to connect to a remote update IHS (similar to the IHS 100, described above with reference to FIG. 1) through the network 210. The update IHS may include software updates to be transferred to the event recognition engine 204 and action profiles to be transferred to the action profiles database 306. If software updates or action profiles are available from the update IHS, the communication interface 208 may transfer them through the network 210 and the event recognition engine 204 may use them to update the event recognition engine 204 and/or add them to the action profiles database 206. If no software updates or action profiles are available from the update IHS, block 302 of the method 300 may be skipped, and the method 300 may begin with block 304.

The method 300 then proceeds to block 304 where an event input is received. In an embodiment, one or more event inputs may be received. The one or more event sensors 202 may detect an event (or a plurality of events) and generate an event input (or a plurality of event inputs), and the event recognition engine 204 may then receive that event input (or plurality of event inputs). For example, the one or more event sensors 202 may detect a sound event (e.g., a baby crying, a phone ringing, an alarm sounding, a particular word, a car engine, a door opening or closing, and/or a variety of other sound events known in the art), a location event (e.g., the sensor is in a particular location, the amount of time it has taken for the sensor to move from one location to another, and/or a variety of other location events known in the art), a light event (e.g., a light has been detected, a light is no longer being detected, a light intensity has increased over a predetermined threshold, a light intensity has decreased below a predetermined threshold, and/or a variety of other light events known in the art), a chemical event (e.g., a chemical has been detected, a chemical is no longer being detected, a chemical concentration has increased over a predetermined threshold, a chemical concentration has decreased below a predetermined threshold, and/or a variety of other chemical events known in the art), a movement event (e.g., the sensor has changed orientation, the sensor has moved suddenly, and/or a variety of other movement events known in the art), a directional event (the sensor has changed direction and/or a variety of other directional events known in the art).

The method 300 then proceeds to block 306 where the event input is compared to the plurality of action profiles. The event recognition engine 204 compares the event input (or plurality of event inputs) received at block 304 of the method 300 and then accesses the action profiles database 206 to compare the event input (or plurality of event inputs) to the plurality of action profiles in the action profiles database 206. As described above, each action profile in the action profiles database 206 includes at least one event. For example, the action profiles may include sound events, location events, light events, chemical events, movement events, directional events, combinations thereof, and/or a variety of other events known in the art. The method 300 then proceeds to block 308 where it is determined if the event input (or plurality of event inputs) matches at least one action profile. The event recognition engine 204 determines if the event input (or plurality of event inputs) received in block 304 of the method 300 matches at least one of the action profiles located in the action profiles database 206. If the event input (or plurality of event inputs) do not match any of the action profiles in the action profile database 206, the method 300 ends. If the event input (or plurality of event inputs) matches one or more of the action profiles in the action profile database 206, the method 300 proceeds to block 310, where a predetermined action is performed. As described above, each action profile in the action profiles database 206 includes at least one predetermined action to be performed in response to detecting at least one event. In response to determining that the event input received in block 304 of the method 300 matches at least one action profile in block 308 of the method 300, the event recognition engine 204 performs the predetermined action included in the action profile that included the event that matched the event input received in block 304 of the method 300. Below, a plurality of specific examples of the method 300 will be described in detail. However, these examples are not meant to be exhaustive, and one of skill in the art will recognize that the examples may be expanded upon while remaining within the scope of the present disclosure.

In an embodiment, the event recognition and response system 200 may include a sound event sensor (e.g., a microphone or other sensor known in the art for detecting sound) or a plurality of sound event sensors as the event sensors 202. The action profiles in the action profiles database 206 may then include or be programmed with a plurality of sampled sound event recordings, and the system 200 may be utilized as a continuous listening device that compares the audio environment of the sound event sensor(s) to the plurality of sampled sound event recordings. For example, at block 302 of the method 300, the action profiles database 206 may be updated (either through the communications interface 208 or locally by the user of the system 200) with a plurality of sampled sound event recordings such as, for example, a baby crying, a phone ringing, an alarm sounding, a particular word, a car engine, a door opening or closing, and/or a variety of sound events known in the art. The updating may be used to provide the action profiles in the action profiles database 206 with, for example, the most recent tone of a baby's voice, a particular ring tone on a phone, a library of car engine sounds from an online database, etc. Such updating may be provided, for example, by an online service that is updated with sound events, and the updating of the system 200 may dynamically change based on the sound events currently being detected by the event sensor 202. Furthermore, each action profile may be associated with one or more sound events, and may also be associated with a predetermined action. At block 304 of the method 300, the event recognition engine 204 may then receive one or more sound event inputs picked up by the sound event sensor(s). At block 306, 308 and 310, the event recognition engine 204 compares the sound event input(s) to the action profiles to determine if any of the action profiles includes the received sound event input(s) and, if so, performs the predetermined action. For example, an action profile may include or be programmed with a single sound event (e.g., a baby crying, a phone ringing, an alarm sounding, a particular word, a car engine, a door opening or closing, etc.), and the action profile may be associated with a predetermined action that include providing a notification that the sound event has occurred. In an embodiment, the notification may include an indication on a display (e.g., an indication via a graphical user interface, a pop-up window, etc), a text message, a phone call, turning off speakers or headphones, and/or a variety of other notifications known in the art. In an embodiment, the notification may include contacting emergency services (e.g., a fire department, police station, etc.). Thus, a user of the system 200 that may not be able to hear the sound event will be notified of the sound event. In another example, the action profile may include or be programmed with both a sound event and a requirement that the sound event exceed a predetermined decibel level. Such an action profile allows the notification to be sent to the user of the system 200 when a word (e.g., 'fire', 'help', etc.) or sound (e.g., a crashing noise, an alarm, etc.) is detected that is above a predetermined decibel level but not when it is detected below a predetermined decibel level. In another example, the action profile may include or be programmed with a plurality of sound events. Such an action profile would allow the notification to be sent to the user of the system 200 when a plurality of sound events (e.g., a car engine and an automatic garage door, a door opening and a particular voice, etc.) occur together (or within a predetermined time of each other) but not when those sound event occur individually. In an embodiment, the action profile may include or be programmed with instructions to ignore particular sound events.

In an embodiment, the event recognition and response system 200 may include a location event sensor (e.g., a global positioning system (GPS) or other sensor known in the art for detecting location) as the event sensor 202. The action profiles in the action profiles database 206 may then include or be programmed with a maximum time difference between two given locations, and the system 200 may be utilized as a speed monitoring device and provide notifications when the system 200 changes positions too quickly. Such an action profile allows the notification to be sent to the user of the system 200 when the location event occurs such that the system 200 changes locations too quickly (e.g., the action profile may include instructions to provide a notification or take a picture of the occupants of a car that includes the system 200 when the car (and hence, the system 200) moves from one location to another too quickly).

In an embodiment, the event recognition and response system 200 may include a sound event sensor (e.g., a microphone or other sensor known in the art for detecting sound) or a plurality of sound event sensors, and a location event sensor (e.g., a global positioning system (GPS) or other sensor known in the art for detecting location) as the event sensors 202. The action profiles in the action profiles database 206 may then include or be programmed with a plurality of sampled sound event recordings that may be associated with particular locations, and the system 200 may be utilized as a continuous listening device that compares the audio environment of the sound event sensor(s) to the plurality of sampled sound event recordings and provides notifications when those sound events occur in predetermined locations. For example, the action profile may include or be programmed with both a sound event and a location event. Such an action profile allows the notification to be sent to the user of the system 200 when the sound event occurs when the system 200 is located in the users home, but not when the system is located in the users place of work (e.g., the action profile may include instructions to provide a notification when a knock on a door is detected at home but not when a knock on the door is detected at work). In another example, an action profile may include or be programmed with a sound event or event(s) and a particular location, and the action profile may be associated with a predetermined action that include creating a database. Such an action profile allows a database to be created of recognized sounds when the user of the system 200 is in a particular location (e.g., whenever the user is in their home, car, particular place of business, etc, the system 200 may be used to recognize songs being played and create a database with a list of the recognized songs). In an embodiment, the action profile may include or be programmed with instructions to ignore particular sound events when the system 200 is in a particular location.

One of skill in the art will recognize how additional sensors (e.g., light event sensors, chemical event sensors, movement event sensors, directional event sensors, combinations thereof, and/or a variety of other sensors known in the art) can be incorporated into the system 200 similar to the examples discussed above in order to provide a variety of functionality that would fall within the scope of the present disclosure. The action profiles associated with such systems could, for example, send notifications, create database, take pictures, turn on or off powered devices, sound alarms, and/or variety of other actions known in the art, in response to detecting light (e.g., the sun rising, the sun setting, a light being turned on or off, etc.), detecting a chemical (e.g., a harmful chemical, a chemical associated with a undesirable smell, etc.), detecting movement (e.g., the system 200 experiencing a sudden acceleration, the system 200 experiencing a sudden deceleration, etc.), detecting a directional change (the system 200 being reoriented), or combinations of these, any of the examples detailed above, or other examples that would be apparent to those skilled in the art. Furthermore, those action profiles may be programmed and/or updated through a network to ensure that the predetermined actions are performed accurately.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An event recognition and response system, comprising:

a plurality of event sensors including a location event sensor;

an event recognition engine coupled to the plurality of event sensors; and an action profile database coupled to the event recognition engine, wherein the event recognition engine is operable to receive a location event input from the location event sensor and at least one other event input from at least one other event sensor of the plurality of event sensors, compare the location event input and the at least one other event input to a plurality of action profiles in the action profile database and, upon determining that at least one action profile in the action profile database is associated with the location event input and the at least one other event input, perform a predetermined action;

wherein the predetermined action comprises providing a notification in response to the location event input corresponding to a first location event; and wherein the predetermined action comprises ignoring the at least one other event input in response to the location event input corresponding to a second location event that is different from the first location event.

2. The system of claim 1, wherein the at least one other event sensor comprises a sound event sensor.

3. The system of claim 1, wherein the at least one other event input that is associated with the at least one action profile includes a sound event input.

4. The system of claim 1, further comprising:

a communication interface coupled to a network and the action profile database, wherein the communication interface is operable to allow the transfer of action profiles through the network to the action profile database.

5. The system of claim 1, wherein the at least one other event input received from the at least one other event sensor of the plurality of event sensors includes a plurality of sound event inputs, and wherein the event recognition engine is operable to determine that the plurality of sound event inputs are related sound event inputs, determine that the related sound event inputs are associated with the at least one action profile that is associated with the location event input and, in response, perform the predetermined action.

6. An event recognition and response system, comprising:

an event sensor;

an event recognition engine coupled to the event sensor; and an action profile database coupled to the event recognition engine, wherein the event recognition engine is operable to receive a plurality of event inputs from the event sensor, compare the plurality of event inputs to a plurality of action profiles in the action profile database and, upon determining that an action profile in the action profile database is associated with the plurality of event inputs, perform a predetermined action;

wherein at least one of the plurality of event inputs comprises a sound event, and at least one of the plurality of event inputs comprises a location event; and wherein the predetermined action comprises ignoring the sound event in response to the location event.

7. An information handling system, comprising:

a chassis housing a processor;

an event sensor coupled to the chassis; and a computer-readable medium coupled to the processor, the computer-readable medium comprising:

an event recognition engine coupled to the event sensor; and an action profile database coupled to the event recognition engine, wherein the event recognition engine is operable to receive a plurality of sound event inputs from the event sensor, determine that the plurality of sound event inputs are related sound event inputs, compare the related sound event inputs to a plurality of action profiles in the action profile database and, upon determining that at least one action profile in the action profile database is associated with the related sound event inputs, perform a predetermined action.

8. The system of claim 7, wherein the event sensor comprises at least one sound event sensor.

9. The system of claim 7, wherein the determination that the plurality of sound event inputs are related sound event inputs includes determining that the plurality of sound event inputs have been received within a predetermined time.

10. The system of claim 7, wherein the predetermined action comprises a notification on a display that is coupled to the processor and the chassis.

11. The system of claim 7, further comprising:

a communication interface coupled to a network and the action profile database, wherein the communication interface is operable to allow the transfer of action profiles through the network to the action profile database.

12. The system of claim 7, wherein the event recognition engine is operable to receive a location event input from the event sensor, determine that the related sound event inputs and the location event input are associated with the at least one action profile and, in response, perform the predetermined action.

13. An information handling system, comprising:

a chassis housing a processor;

an event sensor coupled to the chassis; and a computer-readable medium coupled to the processor, the computer-readable medium comprising:

an event recognition engine coupled to the event sensor; and an action profile database coupled to the event recognition engine, wherein the event recognition engine is operable to receive a plurality of event inputs from the event sensor, compare the plurality of event inputs to a plurality of action profiles in the action profile database and, upon determining that at least one action profile in the action profile database matches the plurality of event inputs, perform a predetermined action;

wherein at least one of the plurality of event inputs comprises a sound event, and at least one of the plurality of event inputs comprises a location event; and wherein the predetermined action comprises ignoring the sound event in response to the location event.

14. A method for recognizing an event and providing a response, comprising:

receiving, from an event sensor, a plurality of sound event inputs;

determining that the plurality of sound event inputs are related sound event inputs;

comparing the related sound event inputs to a plurality of action profiles in an action profile database;

determining that the related sound event inputs are associated with at least one of the plurality of action profiles; and performing a predetermined action in response to determining the related sound event inputs are associated with the at least one of the plurality of action profiles.

15. The method of claim 14, wherein the predetermined action comprises providing a notification on an information handling system display.

16. A method for recognizing an event and providing a response, comprising:

receiving, from a plurality of event sensors, a location event input and at least one other event input;

comparing the location event input and the at least one other event input to a plurality of action profiles in an action profile database;

determining that at least one of the action profiles in the action profile database is associated with the location event input and the at least one other event input; and performing a predetermined action in response to determining the location event input and the at least one other event input are associated with the at least one of the action profiles, wherein the predetermined action comprises ignoring the at least one other event input in response to the location event input corresponding to a first location event.

17. The method of claim 16, wherein the predetermined action comprises providing a notification on an information handling system display in response to the location event input corresponding to a first location event.

* * * * *